US006088927A

United States Patent [19]

Fleissner

[11] Patent Number: 6,088,927

[45] Date of Patent: Jul. 18, 2000

[54] DEVICE FOR THROUGH-FLOW CONTINUOUS PROCESSING OF TEXTILES OR THE LIKE

[75] Inventor: Gerold Fleissner, Zug, Switzerland

[73] Assignee: Fleissner GmbH & Co., Maschinenfabrik, Egelsbach, Germany

[21] Appl. No.: 09/251,726

[22] Filed: Feb. 18, 1999

[30] Foreign Application Priority Data

Feb. 18, 1998 [DE] Germany ..... 198 06 614

[51] Int. Cl.[7] ..... F26B 13/18

[52] U.S. Cl. ..... 34/122; 34/123; 68/5 D

[58] Field of Search ..... 34/108, 109, 110, 34/111, 114, 115, 122, 123; 68/5, 158

[56] References Cited

U.S. PATENT DOCUMENTS 4,811,574 3/1989 Fleissner ..... 68/5 D
5,052,197 10/1991 Fleissner ..... 68/5 D
5,609,046 3/1997 Flesissner ..... 68/5 D

FOREIGN PATENT DOCUMENTS

3821330 A1 12/1989 Germany ..... D06B 23/04

*Primary Examiner*—Denise Ferensic
*Assistant Examiner*—Michelle A Mattera
*Attorney, Agent, or Firm*—Antonelli, Terry, Stout & Kraus, LLP

[57] ABSTRACT

The invention describes a device for through-flow continuous processing of textiles, nonwovens, or paper in web form with a gaseous processing medium circulated in the device. The material rests on the outside of a permeable drum subjected to suction, said drum having bottoms on the ends, namely a sieve-type or perforated covering that rests on the drum structure. For this purpose, sheet metal strips firmly connected with the bottoms extend from one bottom to the other between the bottoms of the drum, with the widths of the strips extending in the radial direction. These sheet metal strips are secured over their entire radially aligned height firmly but releasably to the corresponding bottoms by means of the clamping structure.

10 Claims, 2 Drawing Sheets

DEVICE FOR THROUGH-FLOW CONTINUOUS PROCESSING OF TEXTILES OR THE LIKE

The invention relates to a device for through-flow continuous processing of textiles, nonwovens, or paper in web form, with a gaseous processing medium circulating in the device, with a permeable drum that is under suction and has bottoms endwise as the transport element. The drum is covered on its circumference by a sieve-type or perforated covering. Sheet metal strips firmly connected with the bottoms extend between the bottoms of the drum from one bottom to the other, with the widths of said strips extending in the radial direction.

A device of this kind is known from DE 38 21 330 A1. It has the advantage that it is optimally permeable to air without the stability of the drum being reduced thereby. Another advantage is the bolted construction used in this device. Without having to resort to the welded construction used previously, all of the drum jacket elements are firmly connected with one another in this fashion by the bolted rib connections through the connecting ribs that extend in the circumferential direction with the sheet metal strips that extend lengthwise through the drum, all the way around the drum. The structural changes in the metal that are so disadvantageous when producing the otherwise necessary welded seats are avoided with this bolted construction.

Regardless of whether the drum jacket construction is welded or manufactured using bolted connections, the connection between the sheet metal strips and the bottoms of the drum, in other words with a bottom in one case and with the nozzle star by which the fan produces a vacuum inside the drum on the other, is subjected to greater thermal stresses when used in practice. The bottoms have a larger thermal capacity than the sheet metal strips. When a cold material enters the heated drum housing, the sheet metal strips are cooled shockwise upon contact with the material. This is initially not the case for the bottoms, so that greater stresses develop in the material which produce cracks or bulges in the drum. This occurs regardless of the drum construction, in other words regardless of whether it is welded or bolted.

The differential thermal expansion phenomenon can be controlled by a proper choice of different materials for the drum bottoms and for the individual elements of the air-permeable drum construction. However, the stable fastening of the sheet metal strips to the drum bottoms is important. This can be done by using welded seams, but this results in thermal stresses in the material during manufacture. The bolted construction is better in this regard, but it is necessarily limited to the dimensions of the bolts and causes high local stresses at the edges of the bolt holes for example, so that the bolted construction cannot be a perfect solution.

The goal of the invention is to produce a connection between the sheet metal strips and the adjacent bottoms of the drum which combines the advantages of the two above-mentioned fastening modes but avoids their disadvantages.

Beginning with the drum designed with sheet metal strips of the species described at the outset, the invention provides as a solution for the stated goal that the sheet metal strips are connected over their entire radially aligned height firmly but releasably with the associated bottoms. This is advantageously possible with a clamping connection that clamps the strips in a stable fashion over their entire heights. One possible design solution is obtained when the bottoms have one radially aligned clamping groove for each two sheet metal strips. The radial height of the arrangement of sheet metal strips relative to the opening cross section of the groove corresponds to the distance between two adjacent sheet metal strips.

A device of the type according to the invention is shown as an example in the drawing. Other design details will now be described with reference to the drawing.

Figure 1:
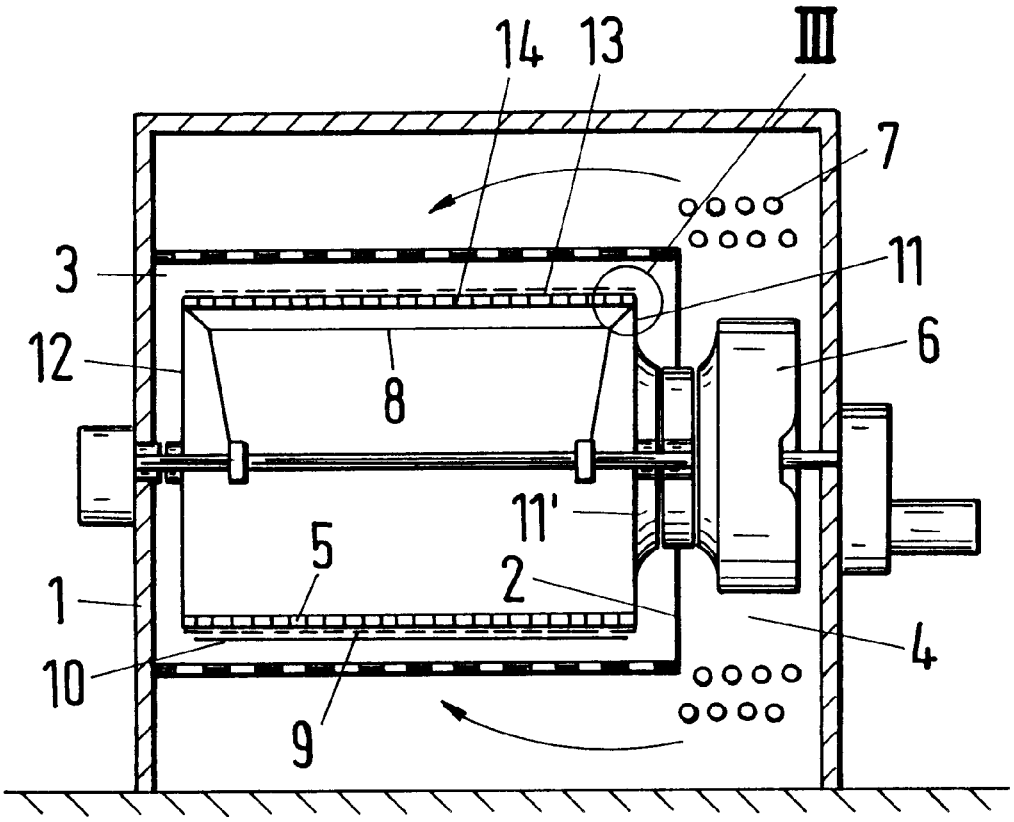
FIG. 1 shows a section along a conventional screen drum device whose sheet metal jacket in this case consists of a strip-shaped sheet metal jacket structure with a sieve fabric applied externally.

A screen drum device basically consists of an approximately rectangular housing 1 divided by a partition 2 into a processing chamber 3 and a fan chamber 4. The screen drum 5 is mounted in processing chamber 3 and a fan 6 is mounted rotatably concentrically with respect to the drum in fan chamber 4. Of course, the fan chamber can also be located in a separate fan housing, not shown here, separated from the screen drum housing 1. In any case, the fan produces suction inside drum 5. A drum designed for a wet-processing device, which also can serve only to draw off fluid, is the subject of the patent. The entire design is then adjusted accordingly.

According to FIG. 1, heating assemblies 7 are located above and below fan 6, said assemblies consisting of two pipes through which heating medium flows. The screen drum is covered internally by an internal covering, not shown, against the suction in the area that is not covered by textile 10. The jacket structure of the screen drum that supports textile 10 is formed by the sheet metal strip structure described below. This structure is wrapped externally by a fine-mesh sieve 9 which is held stretched against the end of the drum at the bottom 12 and at the bottom 11 and with nozzle star 11'.

Figure 5:
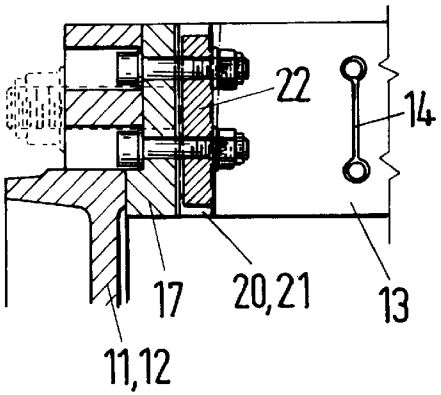
FIG. 5 shows a section through the fastening to the drum bottom along line V—V in FIG. 3.
Figure 3:
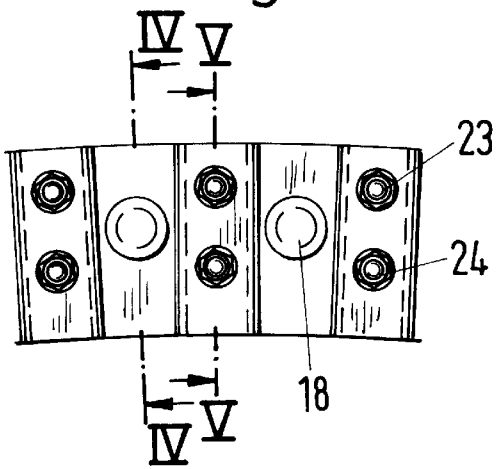
FIG. 3 shows the fastening of sheet metal strips to the drum bottom in a view along section III—III in FIG. 2.
Figure 4:
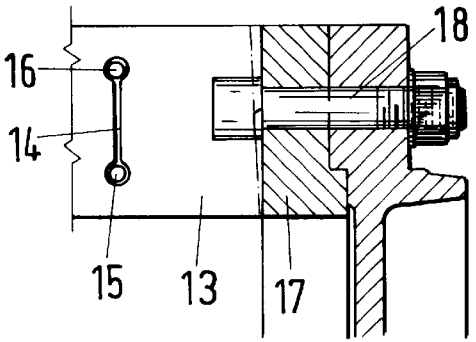
FIG. 4 shows a section through the fastening to the drum bottom along line IV—IV in FIG. 3.

The sheet metal strip structure consists of axially aligned sheet metal strips 13 whose radially outlined height projects out of FIGS. 3–5. Thus, the sieve-shaped covering 9 according to FIG. 1 lies only on the edges of the sheet metal strips 3 that face radially outward.

Figure 2:
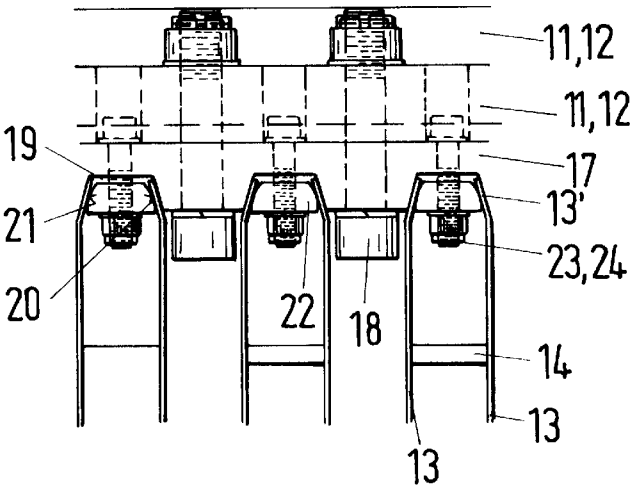
FIG. 2 shows detail III in FIG. 1 in a top view of the screen drum design in the vicinity of an endwise drum bottom.

Sheet metal strips 13 according to FIG. 2 are fastened at specific intervals side by side to the two bottoms 11, 12. The distance is determined by the length of connecting ribs 14 located between all the sheet metal strips 13. Bolts 15, 16 are pushed through these ribs to provide fastening all around. For axial fastening of sheet metal strips 13 to bottoms 11, 12, a clamping design is used that grips the sheet metal strips 13 over their entire radial height. The clamping structure is accommodated in a separate centering ring 17 which in turn is connected by bolts 18 to the respective bottom 11 or 12. Centering ring 17 is fastened to the corresponding bottom 11 or 12 by bolts 18 alternating with the fastening of the sheet metal strips 13 to the centering ring 17 by means of the bolts 23, 24; see also FIGS. 2 and 3.

As can be seen from FIG. 2, a radially aligned clamping groove 19 is provided in the centering ring 17 for each two sheet metal strips 13. The aperture cross section of the groove corresponds to the distance between the two adjacent sheet metal strips 13. The clamping groove 19 then narrows conically toward ends 13' of sheet metal strips 13 to form clamping jaws 20, 21. A clamping pin 22 fits into clamping groove 19, with the radially aligned side cheeks of said pin being adjusted to the tilt of clamping jaws 20, 21 of clamping groove 19 in such fashion that clamping pin 22 corresponds in its width dimension to the clamping groove 19 minus the material thickness of the two adjacent sheet metal strips 13. When clamping pin 22 is tightened against centering ring 17 by means of the two bolts 23 and 24 according to FIG. 5, the ends of the two clamped sheet metal strips 13 are held firmly against centering ring 17 over their entire heights and also over a certain width, in other words over their complete area. A permanent stable fastening of sheet metal strips 13 to bottoms 11, 12 is thus achieved.

What is claimed is:

1. Device for through-flow continuous processing of textiles, nonwovens, or paper in web form with a gaseous processing medium circulated in the device, with a permeable drum (5) subjected to suction and having bottoms (11, 12) endwise, said drum being covered on its circumference by a sieve-type or perforated covering (9), with sheet metal strips (13) permanently connected between bottoms (11, 12) of drum (5) with bottoms (11, 12), said strips extending from bottom (11) to bottom (12), with the width of said strips extending in the radial direction, characterized in that sheet metal strips (13) are connected over their entire radially directed height firmly but releasably with associated bottoms (11, 12).

2. Device according to claim 1 characterized in that a clamping connection (19–22) is provided for fastening sheet metal strips (13) with associated bottoms (11, 12).

3. Device according to claim 2 characterized in that bottoms (11, 12) have radially directed clamping grooves (19) in the radial height of the arrangement of sheet metal strips (13) for each two sheet metal strips (13), with the aperture cross section of the groove corresponding to the distance between two adjacent sheet metal strips (13).

4. Device according to claim 3 characterized in that clamping groove (19) tapers conically toward bottom (11, 12) toward ends (13') of sheet metal strips (13) to form clamping jaws (21, 22).

5. Device according to claim 4, characterized in that a clamping pin (22) is located between two associated sheet metal strips (13) within clamping groove (19), with the radially aligned side cheeks of said pin being adapted to the tilt of clamping jaws (21, 22) of clamping groove (19).

6. Device accorded to claim 5, characterized in that clamping pin (22) corresponds in its width dimension to clamping groove (19) minus the material thickness of two adjacent sheet metal strips (13).

7. Device accorded to claim 5 characterized in that clamping pin (22) is preferably secured to corresponding bottom (11 or 12) by two bolts (23, 24).

8. Device according to claim 5, characterized in that the respective axially aligned ends (13') of two adjacent sheet metal strips (13) are secured over their complete areas between clamping jaws (20, 21) of clamping groove (19) and the side cheeks of clamping pin (22).

9. Device according to claim 2, characterized in that clamping grooves (19) for sheet metal strips (13) are accommodated in a centering ring (17) and centering ring (17) in turn is secured to the corresponding bottom (11 or 12) by a bolted connection (18).

10. Device according to claim 9 characterized in that bolted connection (18) between centering ring (17) and bottom (11, 12) in each case is provided in the circumferential direction behind a clamping groove (19), in other words between two clamping grooves (19).

* * * * *